US007568815B2

(12) United States Patent
Lee et al.

(10) Patent No.: US 7,568,815 B2
(45) Date of Patent: Aug. 4, 2009

(54) LIGHT SOURCE HAVING A PLURALITY OF WHITE LEDS WITH DIFFERENT OUTPUT SPECTRA

(75) Inventors: Joon Chok Lee, Kuching Sarawak (MY); Kee Yean Ng, Penang (MY); Chee Wai Chia, Penang (MY); David C. Feldmeier, Redwood City, CA (US)

(73) Assignee: Avago Technologies ECBU IP (Singapore) Pte. Ltd., Singapore (SG)

( * ) Notice: Subject to any disclaimer, the term of this patent is extended or adjusted under 35 U.S.C. 154(b) by 161 days.

(21) Appl. No.: 11/691,343

(22) Filed: Mar. 26, 2007

(65) Prior Publication Data

US 2008/0238335 A1 Oct. 2, 2008

(51) Int. Cl.
*F21V 9/00* (2006.01)

(52) U.S. Cl. ..... 362/231; 362/230; 362/227

(58) Field of Classification Search ..... 315/293, 315/285; 362/230, 231, 227
See application file for complete search history.

(56) References Cited

U.S. PATENT DOCUMENTS

| | | | | |
|---|---|---|---|---|
| 7,066,623 | B2 | 6/2006 | Lee et al. | |
| 2006/0215407 | A1 | 9/2006 | Lee | |
| 2007/0235639 | A1 * | 10/2007 | Rains, Jr. | 250/228 |

* cited by examiner

*Primary Examiner*—Tuyet Vo

(57) ABSTRACT

A solid state light source having first and second component light sources and an interface circuit and a method for making the same are disclosed. The first and second component light sources emit light having first and second color points on different sides of the black body radiation curve. The first and second component light sources include LEDs that emit light of a first wavelength and a layer of a light converting material that converts a portion of that light to light of a second wavelength. The interface circuit powers the first and second component light sources such that the solid state light source has a color point that is closer to the black body radiation curve than either the first or second color points. A third component light source can be included to expand the range of white color temperatures that can be reached by the light source.

9 Claims, 6 Drawing Sheets

COLOR TEMPERATURE/ AND/OR INTENSITY

LIGHT SOURCE HAVING A PLURALITY OF WHITE LEDS WITH DIFFERENT OUTPUT SPECTRA

BACKGROUND OF THE INVENTION

Light emitting diodes (LEDs) are attractive candidates for replacing conventional light sources such as incandescent lamps and fluorescent light sources. LEDs have higher light conversion efficiencies than incandescent lamps and longer lifetimes than both types of conventional sources. In addition, some types of LEDs now have higher conversion efficiencies than fluorescent light sources, and still higher conversion efficiencies have been demonstrated in the laboratory.

Unfortunately, LEDs produce light in a relatively narrow spectral band. Hence, to produce a light source having an arbitrary color, a compound light source having multiple LEDs is often utilized. For example, an LED-based light source that provides an emission that is perceived as matching a particular color can be constructed by combining light from red, green, and blue emitting LEDs. The ratio of the intensities of the various colors sets the color of the light as perceived by a human observer.

To replace conventional lighting systems, LED-based sources that generate light that appears to be "white" to a human observer are required. A light source that appears to be white and that has a conversion efficiency comparable to that of fluorescent light sources can be constructed from a blue LED that is covered with a layer of phosphor that converts a portion of the blue light to yellow light. Such light sources will be referred to as "phosphor converted" light sources in the following discussion. If the ratio of blue to yellow light is chosen correctly, the resultant light source appears white to a human observer.

Unfortunately, the uniformity of such phosphor converted light sources presents problems, particularly when two white LEDs are used to illuminate displays that are viewed simultaneously by an observer. Not all white light sources appear the same. For example, incandescent lights emit a spectrum that is approximated by a black body heated to a "color temperature". If the lights are operated such that the color temperature is high, the white light appears more bluish. If the color temperature is low, the light appears to be more reddish and is perceived to be "warmer" than the higher color temperature light.

White LEDs also vary in their effective color temperature depending on the specific phosphor used to convert the blue light and the amount of phosphor that covers the LED. If too little phosphor covers the LED, the light source appears bluish, since a greater quantity of blue light will escape the LED without being converted. Similarly, if the phosphor layer is too thick, the light source will appear yellowish, since too much of the blue light will have been converted.

The amount of phosphor that overlies the LED die and the manner in which that phosphor is illuminated can vary significantly during the manufacturing process from batch to batch as well as between light sources fabricated in the same batch. As a result, individual LEDs can vary significantly in their effective "color temperature". If two LEDs that differ significantly from one another are used to illuminate displays that are viewed simultaneously by a human observer, the differences in the emitted spectra are often objectionable to the observer.

A number of solutions have been proposed to reduce the magnitude of this problem. The simplest solution is to sort the LEDs into groups that have similar color temperatures. However, such sorting involves additional tests and increases the inventory problems associated with the manufacture of light sources.

Another solution involves combining a white LED with two or more non-phosphor converted LEDs to produce a light source in which the additional LEDs are used to tune the effective color temperature of the source. For example, U.S. patent application Ser. No. 11/086,138 teaches a scheme in which two red LEDs are combined with a white light source to produce a light source with a controllable color temperature. Similarly, co-pending U.S. patent application Ser. No. 11/523,409 teaches a controllable color temperature white light source that utilizes a white LED together with red, blue, and green LEDs in which the red, blue, and green LEDs are used to tune the color temperature.

These solutions, however, lead to a light source having lower light conversion efficiency than that of the phosphor converted white LEDs. Light conversion efficiency is an important factor in light source design. For the purposes of this discussion, the light conversion efficiency of a light source is defined to be the amount of light generated per watt of electricity consumed by the light source. The presently available phosphor converted white light sources have achieved light conversion efficiencies that are better than those of fluorescent lamps that generate white light. These high light conversion efficiencies are the result of improvements in blue LEDs. The light conversion efficiency of other types of LEDs is lower, and hence, using a combination of phosphor converted white LEDs and non-blue LEDs leads to a light source having a lower overall light conversion efficiency.

Yet another solution is taught in U.S. Pat. No. 7,066,623. This solution utilizes an arrangement in which the various white LEDs are generated with somewhat different blue LEDs to produce LEDs that vary in color about the black body curve. A compound light source having plurality of these off-white light sources is then constructed by testing each LED and grouping the LEDs such that the off-white properties of the LEDs effectively cancel when the LEDs are powered at the same current level. At least one LED from each color grouping is incorporated in the light source to assure that the various LEDs lie on both sides of the black body radiation curve. Hence, the resultant LED appears to be pure white with an intensity equal to that of several white LEDs. This solution requires that the LEDs be both tested and carefully matched. The matching process is inefficient and time consuming. In addition, the color temperature of the final white light source cannot be closely controlled without further sorting and grouping.

SUMMARY OF THE INVENTION

The present invention includes a solid state light source having first and second component light sources and an interface circuit and a method for making the same. The first component light source emits light having a first color point in the CIE 1931 color space diagram on one side of the black body radiation curve. The first component light source includes an LED that emits light of a first wavelength and a first layer of a first light converting material that converts a portion of that light to light of a second wavelength. The second component light source emits light having a second color point in the CIE 1931 color space diagram on the other side of the black body radiation curve. The second component light source includes an LED that emits light of the first wavelength and a second layer of the first light converting material that converts a portion of that light to light of the second wavelength. The interface circuit powers the first and second component light sources such that the solid state light source has a color point that is closer to the black body radiation curve than either the first or second color points. In one aspect of the invention, the solid state light source also includes a third component light source that emits light having a third color point in the CIE 1931 color space diagram that does not lie on a line joining the first and second color points, and the interface circuit also powers the third component light source such that the first, second, and third color points define a triangle in the CIE 1931 color space diagram that includes a portion of the black body radiation curve.

DETAILED DESCRIPTION OF THE PREFERRED EMBODIMENTS OF THE INVENTION

The present invention makes use of two of the features of LEDs that are normally considered disadvantages and applies them to produce a more consistent white color. One feature is the variability between phosphor converted white LEDs, as mentioned above, and discussed in more detail below. The second is the relatively low light output of single LEDs, less than a few Watts at best, which means that most light sources of interest require multiple LEDs to achieve light intensity levels comparable to those of incandescent or fluorescent light sources. The use of multiple LEDs, as required by the present invention, would therefore not entail significantly increased cost over systems in current use.

Figure 1:
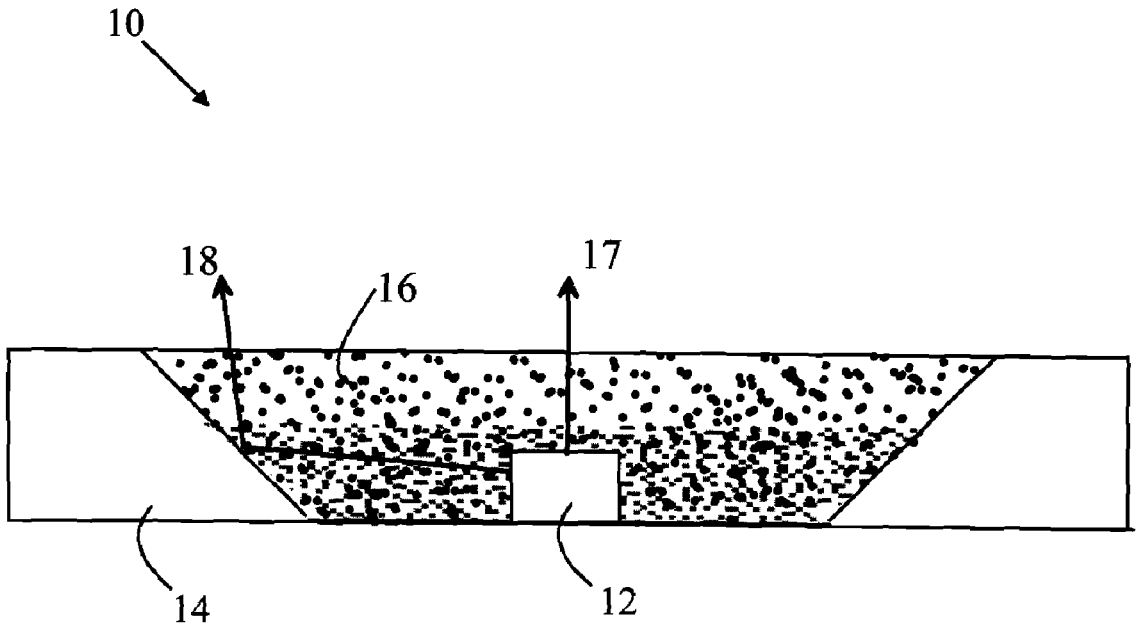
FIGURE 1 (PRIOR ART)
FIG. 1 is a cross-sectional view of a prior art white light LED.

FIG. 1 shows a typical prior art arrangement for a phosphor converted LED source of a type that is currently in general use. A light emitting semiconductor die 12 is mounted within a cavity on a substrate 14. Particles of a phosphor material are mixed into a transparent carrier, typically an epoxy, and the resulting material 16 is applied over the die in the cavity to partially or entirely fill that cavity. Heat and/or UV light is applied to cure the epoxy. In operation, blue light emitted from the die passes into the phosphor mixture, some of the light being converted from blue to yellow, and the resulting mixture of wavelengths leaves the device. The light either leaves directly, as for example ray 17, or after reflection from the side walls of the cavity, as for example ray 18. The mixture of blue and yellow wavelengths gives rise to a perception of a white color when viewed by a human observer. The degree of blueness or yellowness depends on the phosphor concentration distribution encountered by light emerging from different points over the area of the source.

The phosphor concentration varies from device to device for a number of reasons. First, until the epoxy cure is complete, the phosphor particles tend to settle under the influence of gravity, forming a vertical concentration gradient. Differences in the concentration gradient lead to differences in the fraction of the blue light that is converted to yellow as well as variations in perceived color with viewing angle. Second, the quantity of phosphor dispensed into each well also varies due to errors in the dispensing apparatus and/or to settling of the phosphor particles within the reservoir from which the epoxy-phosphor mixture is dispensed.

Third, the distribution of particle sizes in the phosphor preparation also varies from batch to batch for the phosphors that are currently utilized in white LEDs. The phosphor preparation includes a range of phosphor particles in sizes that result from mechanically grinding the phosphor preparation after the precursors have been heated to very high temperatures. The size distributions obtained varies from batch to batch of phosphor. The degree to which the phosphor particles scatter the light as opposed to converting the light from blue to yellow depends on the particle size distribution. In addition, the degree of settling both in the dispenser reservoir and in the individual LEDs prior to curing depends on the particle size. As a result, there is considerable variability from device to device in a single production batch as well as from batch to batch. In addition, the blue LEDs also vary in the wavelength of light generated. This adds additional variability to the final color of the final "white" LED.

Figure 2:
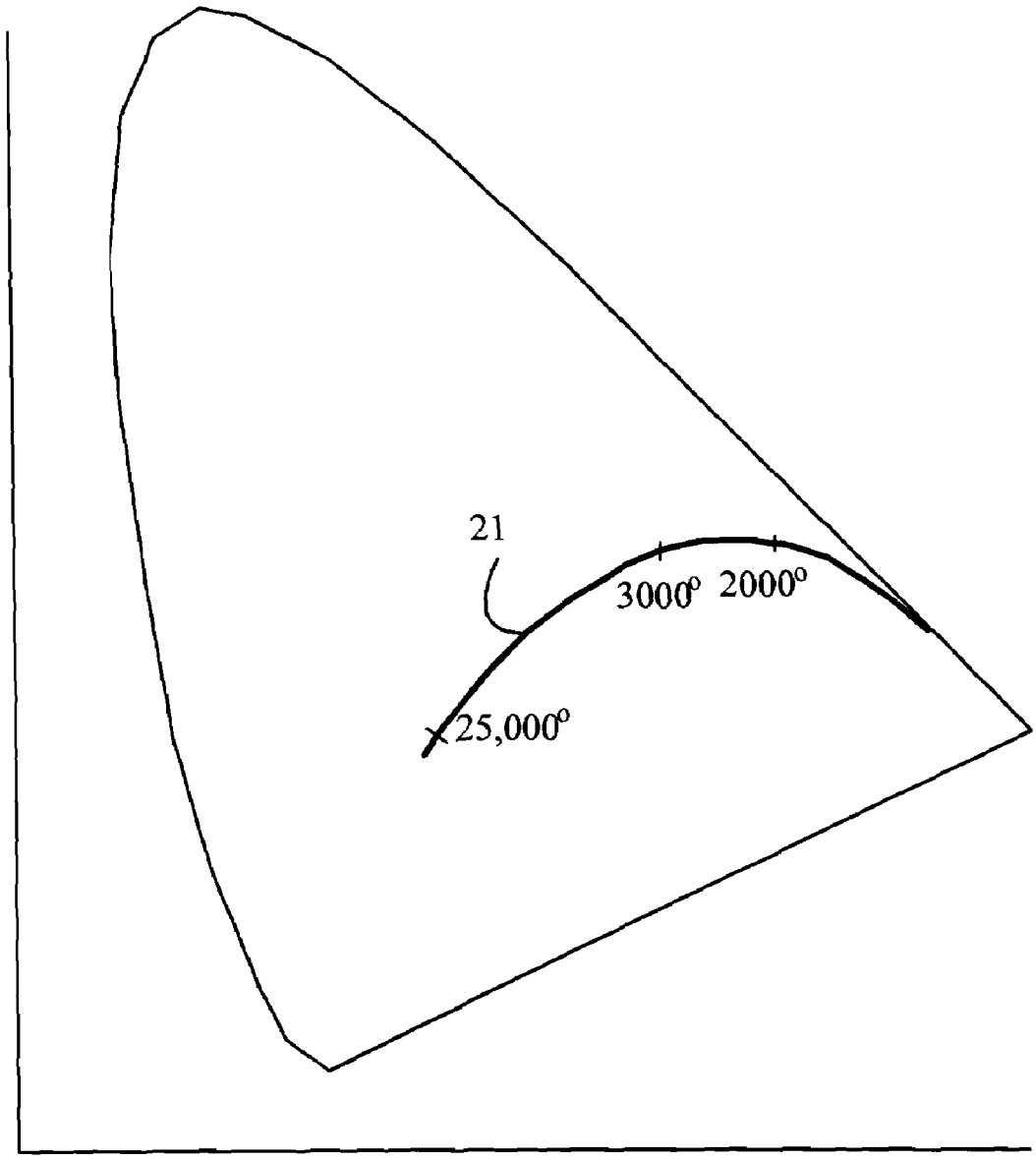
FIG. 2 is a representation of the CIE 1932 color space diagram showing some specific color temperature points.

FIG. 2 illustrates the black body curve in the conventional CIE 1931 color space diagram. It is often desirable to produce a light source whose output can be characterized by a color point falling on, or very close to, the black body curve shown at 21. Curve 21 is the locus of color points generated by a black body heated to the temperatures shown along curve 21. For a non-black body source, the locations along curve 21 are commonly referred to as the correlated color temperature (CCT) of the light source, since the output color is perceived to be the same as that from a black body heated to the temperature in question.

Figure 3:
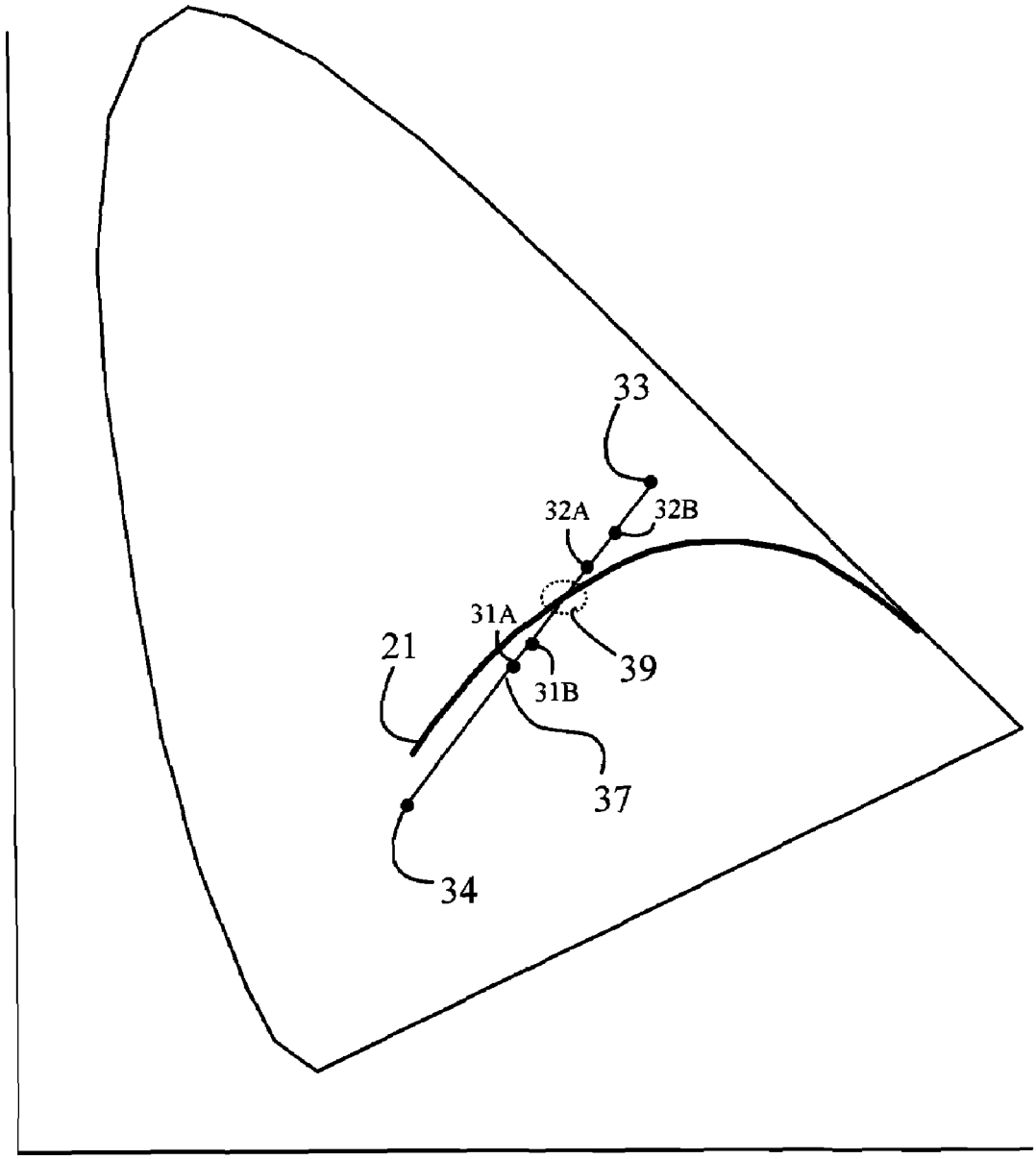
FIG. 3 is a representation of the CIE 1932 color space diagram showing points corresponding to a pair of white LEDs.

One embodiment of the present invention is based on the observation that white LEDs constructed from a particular blue light source and phosphor will have a variability that lies along a line in the color space. The various factors that cause the LEDs to vary in CCT are primarily the result of alterations in the ratio of blue to yellow light from LED to LED, and hence, lie on the line connecting the blue light source to the light source that would be obtained if all of the blue light were converted to yellow. Refer now to FIG. 3, which illustrates the points along this line. A light source in which none of the blue light is converted to yellow is represented by point 34. Similarly, a light source in which all of the blue light is converted to yellow light by the phosphor is represented by point 33. In practice, the individual LEDs have perceived colors that lie along line 37. Two LEDs that have too little yellow light are shown at 31A-B, and two LEDs that have too much yellow light are shown at 32A-B. The LEDs were presumably designed to have color points that lie in the region shown at 39.

Consider a light source that is constructed from two LEDs having color points along line 37. If one of these LEDs has a color point above curve 21 and the other has a color point that is below curve 21, then a light source having a color point in region 39 can be obtained by adjusting the relative intensities of the two LEDs. Hence, this embodiment of the present invention operates by pairing LEDs that lie above curve 21 with LEDs that lie below curve 21 and varying the relative intensities of the LEDs in each pair such that the resulting compound light source has a color point in region 39. As a result, compound light sources having very uniform CCTs are obtained even though the individual LEDs vary widely in CCT.

Since the ratio of the drive currents to the two LEDs is controlled by a controller that is part of the light source, careful matching of the LEDs to provide a compound light source that lies on the curve 21 is not required. As long as one LED lies above the curve and the other LED lies below the curve, the relative currents through the two LEDs can be adjusted to provide a color point on, or very near, curve 21. Accordingly, the present invention requires only a rough screening of the LEDs to separate the LEDs into two groups. The light source is then constructed from at least one LED from each group.

As noted above, almost any practical light source designed to replace conventional light sources must utilize multiple LEDs, since the light intensity available from any one LED is too low to provide the equivalent illumination level. In addition, the present fabrication methods require that the LEDs be sorted after production to obtain LEDs having similar CCTs. Hence, an embodiment in which the LEDs are paired as above does not require significant additional cost in terms of the fabrication effort or number of LEDs that must be utilized to provide a light source using current methods.

Figure 4:
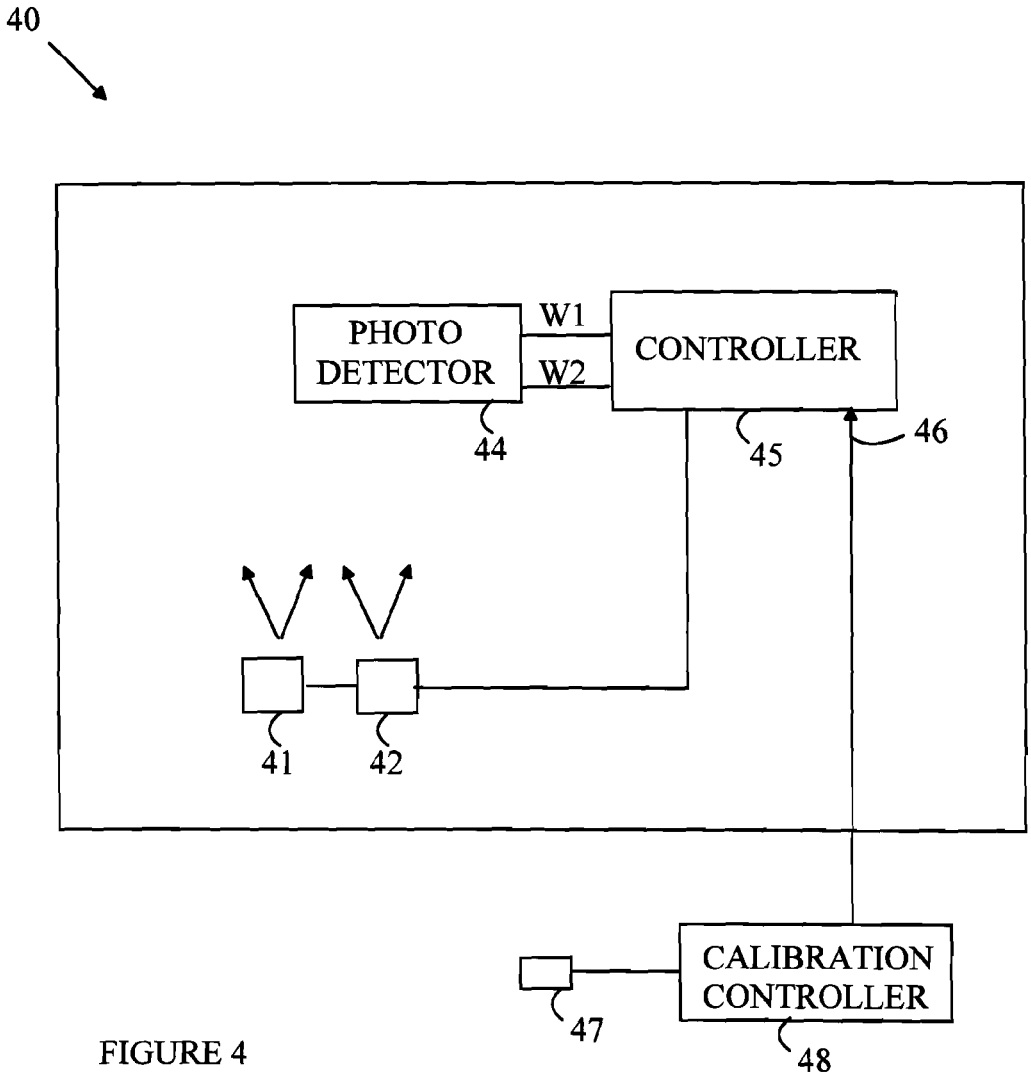
FIG. 4 is a schematic of a preferred embodiment of the present invention.

Refer now to FIG. 4, which illustrates one embodiment of a light source according to the present invention. Light source 40 includes two groups of white LEDs 41 and 42 that are chosen from batches that have significantly different blue/yellow ratios. Each group is driven by a separate driver that is included in controller 45.

All of the LEDs in a group are driven under conditions that maintain the ratios of the light outputs of the various LEDs with respect to one another constant within the group. For example, in one embodiment, the LEDs in each group are connected in series such that each LED in a group is driven with the same current. Controller 45 maintains the ratio of the drive currents at predetermined levels to provide a light source with the desired CCT.

The LEDs in one group have blue/yellow ratios that place these LEDs at a point below curve 21, and the LEDs in the other group have blue/yellow ratios that place those LEDs at a point above curve 21 on line 37. The LEDs in each group may be viewed as a compound light source having a color point that lies on line 37, one such point being above curve 21 and one such point being below curve 21. Controller 45 maintains the ratio of the light output from these two compound light sources such that the desired CCT is obtained.

It should be noted that the different blue/yellow ratios of the individual LEDs can be the result of variation in the fabrication process or the ratios can be made different by design by using different amounts of phosphor in each group or by using slightly different phosphors.

In the simplest embodiment, controller 45 stores the desired ratio of drive currents for component light sources 41 and 42. Once the desired ratio has been set, controller 45 merely maintains the drive currents at the desired ratio. Assuming that the drive ratio is set at the time the light source 40 is fabricated, the light source appears to the end user as a simple light source that is connected to power and provides light at a fixed CCT and intensity when powered.

If the LEDs age at the same rate, the simple embodiment will provide light at the desired CCT over the lifetime of light source 40. However, the overall intensity of light from light source 40 will decrease over time as the LEDs age. In another embodiment, light source 40 also includes a photodetector 44 that measures the light generated by component light sources 41 and 42 and adjusts the average current supplied to each component light source such that the ratio of intensities of light from the two component light sources remains constant, and hence, the CCT remains constant. In addition, the total light output of light source 40 remains constant over the lifetime of the light source provided the initial intensity is sufficiently below the peak output power of the LEDs. Over time, the light output of the LEDs will decrease, and hence, the drive current will need to be increased. To provide the additional drive current, the initial drive current must be below the maximum drive current for the LEDs.

Photodetector 44 measures the light generated by each of the component light sources. A number of schemes for measuring the output of LEDs are known to the art, and hence, these schemes will not be discussed in detail here. Schemes based on modulating the component light sources at different frequencies, or schemes based on using photodiodes that measure the intensity of light in different wavelength bands could be utilized. For the purpose of the present discussion, it is sufficient to note that photodetector 44 generates a signal indicative of the intensity of light generated by each of the component light sources. Controller 45 then utilizes these measured intensity levels in a servo loop that maintains the output of each of the component light sources at the correct levels by adjusting the average current provided to each component light source.

The above-described embodiments depend on controller 45 storing values that specify the ratio of the drive currents or light levels from the component light sources that are to be maintained. For any given two component light sources this ratio must be determined. The ratio can be determined by measuring the CCT of light source 40 using a calibration controller 48 that includes a calibrated photodetector whose output can be utilized by calibration controller 48 to determine the current CCT for light source 40. In this system, calibration controller 48 causes controller 45 to utilize various drive current ratios by sending signals over bus 46. Calibration controller 48 measures the output of light source 40 for each of these drive current ratios. Calibration controller 48 then determines the correct ratio from the output of photodetector 47 and communicates that ratio to controller 45 with instructions to store the ratio.

In embodiments in which light source 40 includes photodetector 44, photodetector 47 could be replaced by a light source having the desired CCT. In this case, controller 45 utilizes the signals W1 and W2 generated by photodetector 44 when illuminated with the target light source as the target values for the servo loop. That is, calibration controller 48 signals controller 45 to store the current values of the photodetector outputs and to maintain those during subsequent operation.

Refer again to FIG. 3. For white light sources that are based on mixing blue and yellow light, there is generally only one intercept between the line joining the color points of two LEDs and the black body curve. Hence, there is only one CCT that can be reached by such a light source. However, for a particular blue source, it may be possible to have two CCTs that are separated by a significant temperature difference if a line that is more nearly horizontal could be obtained with a different blue or yellow source. It may, therefore, be possible to adjust the drive to the two component light sources such that their combined output matches either of two color temperatures. The input 46 to the controller 45 could then be used to choose either of two "white" color temperatures, assuming that the calibration process described above is carried out for each of two different reference light sources that lie at the two corresponding color temperature points. However, embodiments that can reach a significant number of well separated CCTs can not be constructed with just two component light sources.

Figure 5:
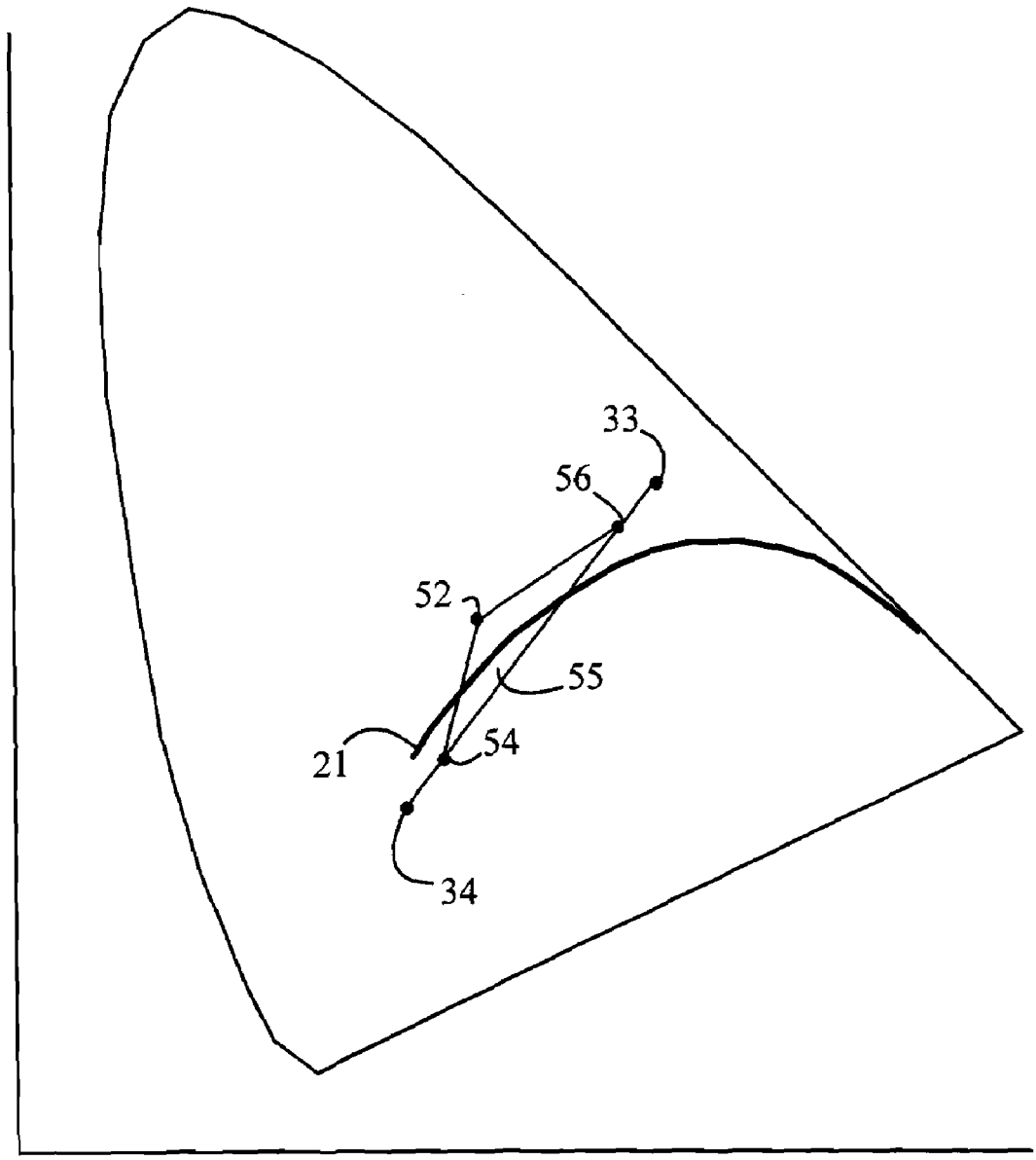
FIG. 5 is a representation of the CIE 1932 color space diagram showing points corresponding to a set of three white LEDs.

A light source that can reach a significant number of well separated CCTs can be constructed if a third component light source is added to the light sources discussed above. Refer now to FIG. 5, which illustrates the region of the color space that can be reached by utilizing 3 phosphor converted component light sources. The first two component light sources lie on the line between color points 33 and 34 discussed above. These two component light sources are shown at 54 and 56 and are constructed in a manner analogous to that discussed above. That is, light sources 54 and 56 are constructed from phosphor converted sources that utilize the same LED and phosphor to generate light that is perceived to be white or nearly white.

A third component light source having a color point shown at 52 is utilized to expand the range of CCTs that can be reached by adjusting the relative intensities of the component light sources to the region shown at 55. Region 55 includes a significant portion of the black body curve, and hence, such a light source can provide a white light source having a range of CCTs while maintaining the conversion efficiency advantages of the phosphor converted light sources.

The third component light source must have a color point that is not on the same line as the remaining two component light sources, and hence, must include a different phosphor composition or LED. For example, the yellow phosphor used in the other two white LEDs could be augmented with a phosphor that converts part of the blue light to green. Once again, the component light source could include a plurality of such LEDs as long as the average of the LEDs provides a color point that is displaced sufficiently to provide the desired region of the black body curve. Alternatively, the third component light source could be a combination of the LEDs used in the other two component light sources plus an additional LED that provides light in the green region of the spectrum. Other embodiments in which the same yellow phosphor is utilized with a different excitation LED could also be utilized.

Figure 6:
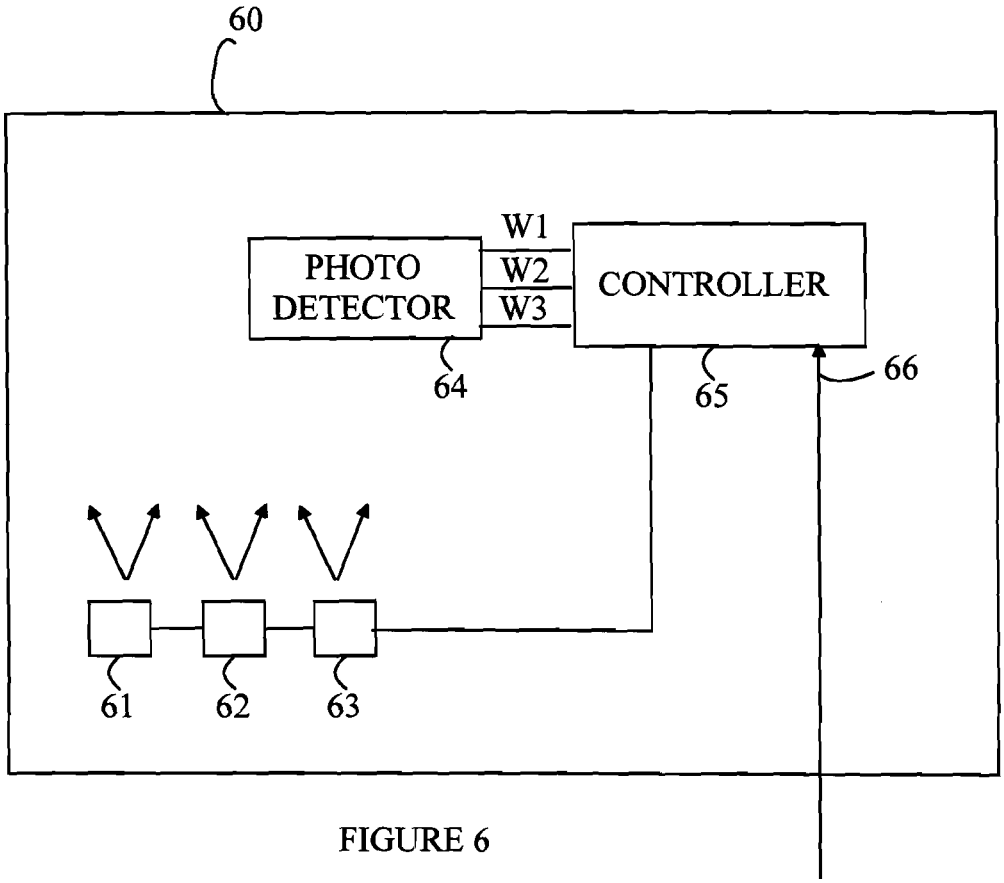
FIG. 6 is a schematic of a second preferred embodiment of the present invention.

Refer now to FIG. 6, which illustrates a three component light source according to one embodiment of the present invention. Light source 60 is constructed from three component light sources 61, 62 and 63. Component light sources 61 and 62 are similar to component light sources 41 and 42 discussed above in that these component light sources are constructed from LEDs that have significantly different blue/yellow ratios. The differences can be the result of production variations or of intentionally varied phosphor concentrations.

Component light source 63 is constructed from a plurality of LEDs that have an average color point that is not on the line connecting the color points corresponding to light sources 61 and 62. The color point for light source 63 is chosen to be sufficiently displaced from the line connecting the color points corresponding to light sources 61 and 62 to assure that at least a portion of the black body radiation curve is contained within the triangle defined by the three component light sources.

A controller 65 drives the sources such that the ratios of the intensities of the component light sources to one another is held constant, and preferably at a point on the black body radiation curve corresponding to the desired CCT. Since light source 60 includes LEDs having a different phosphor system or a different LED type, component light source 63 may age at a rate that is different from that of component light sources 61 and 62. Hence, embodiments in which controller 65 utilizes a photodetector 64 to monitor the actual light output from each component light source and to servo the light sources so as to maintain the color point at the desired CCT can be constructed to prevent color shifts over the lifetime of light source 60.

Light source 60 can be calibrated in a manner analogous to that discussed above. It should be noted that, since light source 60 can achieve a range of CCTs, embodiments in which the CCT can be changed during the operation of the light source are also possible. In this case, controller 65 would include a calibration curve that provides the target values to be used in the servo loop for the various CCTs. Signals specifying the desired CCT could then be sent over bus 66.

Various modifications to the present invention will become apparent to those skilled in the art from the foregoing description and accompanying drawings. Accordingly, the present invention is to be limited solely by the scope of the following claims.

What is claimed is:

1. A solid state light source comprising:

a first component light source that emits light having a first color point in the CIE 1931 color space diagram on one side of the black body radiation curve, said first component light source comprising an LED that emits light of a first wavelength and a first layer of a first light converting material that converts a portion of that light to light of a second wavelength;

a second component light source that emits light having a second color point in the CIE 1931 color space diagram on the other side of said black body radiation curve, said second component light source comprising an LED that emits light of said first wavelength and a second layer of said first light converting material that converts a portion of that light to light of said second wavelength; and an interface circuit that powers said first and second component light sources such that said solid state light source has a color point that is closer to said black body radiation curve than either said first or second color points, wherein said interface circuit sets a first average current through said first component light source and a second average current through said second component light source, said first average current being different from said second average current.

2. The solid state light source of claim 1 wherein said interface circuit comprises a photodetector that generates a first signal indicative of a first intensity of light generated by said first component light source and a second signal indicative of a second intensity of light generated by said second component light source and a controller for altering said first and second average currents so as to maintain said first and second signals at first and second target values.

3. The solid state light source of claim 1 further comprising a third component light source that emits light having a third color point in the CIE 1931 color space diagram that does not lie on a line joining said first and second color points and wherein said interface circuit also powers said third component light source.

4. The solid state light source of claim 3 wherein said first, second, and third color points define a triangle in said CIE 1931 color space diagram that includes a portion of said black body radiation curve.

5. The solid state light source of claim 3 wherein said third component light source comprises an LED that emits light at said first wavelength and a second light converting material that is different from said first light converting material.

6. The solid state light source of claim 3 wherein said third component light source comprises an LED that emits light at a different wavelength than said first wavelength.

7. The solid state light source of claim 3 wherein said interface circuit comprises a photodetector that generates first, second, and third signals indicative of first, second, and third intensities of light generated by said first, second, and third component light sources, respectively, and a controller for altering said first, second, and third average currents so as to maintain said first, second, and third signals at first, second, and third target values, respectively.

8. A method for fabricating a solid state light source comprising:

providing a first component light source that emits light having a first color point in the CIE 1931 color space diagram on one side of the black body radiation curve, said first component light source comprising an LED that emits light of a first wavelength and a first layer of a first light converting material that converts a portion of that light to light of a second wavelength;

providing a second component light source that emits light having a second color point in the CIE 1931 color space diagram on the other side of said black body radiation curve, said second component light source comprising an LED that emits light of said first wavelength and a second layer of said first light converting material that converts a portion of that light to light of said second wavelength;

determining first and second power levels for said first and second component light sources, respectively, such that said solid state light source has a color point that is closer to said black body radiation curve than either said first or second color points when said first and second component light sources are powered at those power levels; and providing an interface circuit that powers said first and second component light sources at those power levels.

9. The method of claim 8 wherein said interface circuit comprises a photodetector that generates signals indicative of light intensities in first and second bands of wavelengths and wherein said power levels are determined by storing values of said signals when said photodetector is illuminated with light having a predetermined color point.

* * * * *